US010722051B2

(12) United States Patent
Dietlin

(10) Patent No.: US 10,722,051 B2
(45) Date of Patent: Jul. 28, 2020

(54) INTERACTIVE DISPLAY STAND FOR OBJECTS, ESPECIALLY WATCHES OR JEWELLERY

(71) Applicant: Omega SA, Biel/Bienne (CH)

(72) Inventor: Xavier Dietlin, Prilly (CH)

(73) Assignee: Omega SA, Biel/Bienne (CH)

( * ) Notice: Subject to any disclaimer, the term of this patent is extended or adjusted under 35 U.S.C. 154(b) by 295 days.

(21) Appl. No.: 15/923,182

(22) Filed: Mar. 16, 2018

(65) Prior Publication Data

US 2018/0263382 A1 Sep. 20, 2018

(30) Foreign Application Priority Data

Mar. 17, 2017 (EP) ..... 17161485

(51) Int. Cl.

| | |
|---|---|
| ***A47F 7/024*** | (2006.01) |
| ***A47F 3/08*** | (2006.01) |
| ***A47F 7/02*** | (2006.01) |
| ***A47F 11/06*** | (2006.01) |
| ***A47F 3/00*** | (2006.01) |

(52) U.S. Cl.

CPC ..... *A47F 7/024* (2013.01); *A47F 3/001* (2013.01); *A47F 3/002* (2013.01); *A47F 3/08* (2013.01); *A47F 7/022* (2013.01); *A47F 11/06* (2013.01)

(58) Field of Classification Search

CPC .. A47F 3/00; A47F 3/001; A47F 3/002; A47F 3/08; A47F 3/085; A47F 7/00; A47F 7/022; A47F 7/024

See application file for complete search history.

(56) References Cited

U.S. PATENT DOCUMENTS 3,575,478 A * 4/1971 Szobski ..... A47F 3/002 312/117
3,729,839 A 5/1973 Bourdier
5,165,768 A * 11/1992 Zarrabi ..... A47F 3/002 312/139

(Continued)

FOREIGN PATENT DOCUMENTS

CN 204048924 12/2014
EP 1 711 088 B1 2/2008

(Continued)

OTHER PUBLICATIONS

European Search Report dated Jul. 21, 2017 in European Application 17161485.2 filed on Mar. 17, 2017 (with English Translation of Categories of Cited Documents).

*Primary Examiner* — Christopher J Boswell
(74) *Attorney, Agent, or Firm* — Oblon, McClelland, Maier & Neustadt, L.L.P.

(57) ABSTRACT

An interactive display stand with a compartment containing objects on supports, and forming an enclosed housing with a single orifice, a driver to control a transporting device to move a support to make only one object visible through the orifice, the user having a device for selecting an object, interfaced with this driver and to align with the orifice the support bearing the object selected for viewing, and including a security detection device for detecting the presence of a hand within the security space, interfaced with the driver to start in such case a programmed cycle, and to lock an object inside this compartment through the orifice.

21 Claims, 10 Drawing Sheets

(56) References Cited

U.S. PATENT DOCUMENTS

| | | | | |
|---|---|---|---|---|
| 5,671,984 | A * | 9/1997 | Kodera | A47F 3/002 312/319.1 |
| 7,905,560 | B2 * | 3/2011 | Vardaro | A47F 3/002 312/139.1 |
| 8,442,676 | B2 * | 5/2013 | Kobayashi | A47F 3/08 221/119 |
| 8,584,845 | B2 | 11/2013 | Soltis, Jr. | |
| 8,733,860 | B1 * | 5/2014 | Burke | A47F 5/03 312/134 |
| 9,078,531 | B1 | 7/2015 | Medawar | |
| 9,681,759 | B2 * | 6/2017 | Schwalbach | A47F 3/001 |
| 10,278,518 | B2 * | 5/2019 | Xie | A47F 7/02 |
| 2003/0209955 | A1 | 11/2003 | Canedy et al. | |
| 2006/0028922 | A1 | 2/2006 | Wolf | |
| 2007/0177465 | A1 * | 8/2007 | Rossi | A47F 7/022 368/206 |
| 2008/0174215 | A1 | 7/2008 | Amstutz et al. | |
| 2010/0314976 | A1 * | 12/2010 | Gardner | A47F 3/002 312/128 |
| 2011/0260589 | A1 | 10/2011 | Soltis, Jr. | |

FOREIGN PATENT DOCUMENTS

| | | |
|---|---|---|
| FR | 1 350 737 | 1/1964 |
| FR | 2 641 399 A1 | 7/1990 |
| WO | WO 2005/089597 A1 | 9/2005 |

* cited by examiner

INTERACTIVE DISPLAY STAND FOR OBJECTS, ESPECIALLY WATCHES OR JEWELLERY

This application claims priority from European Patent Application No. 17161485.2 filed on Mar. 17, 2017; the entire disclosure of which is incorporated herein by reference.

FIELD OF THE INVENTION

The invention concerns an interactive display stand comprising a compartment arranged to contain a plurality of objects to be displayed, secured on at least one support, said compartment forming an enclosed housing accessible through a single orifice, said display stand comprising drive means arranged to control operating means, which comprise transporting means arranged to move at least one said support so that only one object is visible at a time through said orifice, and said display stand comprising control means accessible to a user for selection of a said object, and interfaced with said drive means to control said operating means to align said support bearing said object with said orifice so that the user can view said object.

The invention also concerns a display case including at least one such display stand.

The invention also concerns a watch display structure including at least one such display case or at least one such display stand.

The invention concerns the field of devices for the exhibition of precious objects, especially for horology and jewelry.

BACKGROUND OF THE INVENTION

The presentation of products to the public often requires proximity due to the small size of the objects, especially in the case of horology or jewelry products, which are often objects of great value, and which may require handling precautions.

Production presentation in stores or at trade fair requires showing the product, which explains why, at night, objects of great value, which are difficult to protect if they are openly exhibited, are removed from the display cases. It is thus difficult to showcase valuable items for long time periods.

U.S. Pat. No. 3,729,839A in the name of Bourdier discloses an installation that allows an observer to see an image of a part of himself combined successively with a series of articles of apparel or accessories, this installation allowing the observer to virtually try on these articles and to choose from them without actually wearing them. The installation comprises: a fixed structure carrying a semi-transparent vertical mirror facing the observer, a housing mounted on the fixed structure and opposite the observer with respect to the semi-transparent mirror, said housing having an open front wall, a viewing frame slidably mounted on the open front wall of the housing and arranged to be adjustably moved on a vertical location, the frame comprising a window equipped with a guide mark intended to be placed at the height of the part of the observer, and a movable support mounted in the housing behind the viewing frame, the movable support, on which a series of articles are placed, being actuated by a drive system which causes the articles to appear in succession, one at a time, behind the window of the viewing frame. This invention is applicable to the display of real objects, such as glasses, wigs, and in that case, the installation is arranged in a store window display.

FR Patent Application No 1350737A in the name of Mme Guénard discloses a selective secure display cabinet for valuables. The cabinet has only one element for protection against the risk of burglary, which is supported by an opening or bay in the cabinet, behind which are placed, one by one, at the request of the person interested, but without allowing the person direct access thereto, the various panels bearing the articles to be displayed.

US Patent Application No 2003/209955A1 in the name of Canedy discloses a display case security apparatus that includes a housing, a platform, an elevating mechanism and a closing device. The housing includes a lower storage section and an upper storage section disposed above the lower storage section. The storage section has an opaque exterior wall and the display section has an exterior wall that is at least partially transparent. The platform is disposed within the housing and includes a generally horizontal portion for supporting articles to be displayed. The platform is selectively movable in the vertical direction between a first position, wherein any articles supported on the platform are in the display section of the housing, and a second position, wherein any articles supported on the platform are in the storage section of the housing. The elevating mechanism is mounted within the housing and includes a linear actuator that is selectively extendable along a linear axis between a retracted position and an extended position. The linear actuator is connected between the housing and the platform and is positioned so that the straight line axis is vertically.

US Patent Application No 2008/174215A1 in the name of Amstutz discloses a security display case comprising an enclosure including a security portion and a display portion, a platform movable from the security portion to the display portion, a security element that secures the security portion, a gas spring which moves the platform towards a display portion, and a stabilizing assembly that stabilises the movable platform. Optionally, the gas spring is paired with another gas spring so that the lateral forces from the springs substantially cancel one another out, and the vertical forces are combined to move the platform. The stabilizing assembly may be a rack and pinion gear assembly comprising at least two pinions engaged via a common element which synchronises the rotation of the gears to prevent connection of the platform when the latter is moved. The security element can include doors that fold over the security portion and which are engaged on their edges by a common locking element.

U.S. Pat. No. 9,078,531B1 in the name of Medawar discloses a display case for easily moving items in a safe. The display case comprises a first display portion and a second safe portion. The front and back walls of the second safe portion include first upper panels which pivot to form the upper wall of the safe. A lift mechanism is mounted in the second safe portion to move the items from the display position to the security position stored inside the second safe portion. A control system controls the first upper panels and the lift mechanism.

SUMMARY OF THE INVENTION

The invention proposes to improve the viewing conditions, for the public, of a precious object of small size, and its presentation conditions, with an interactive content.

To this end, the invention concerns an interactive display stand according to claim 1.

The invention also concerns a display case including at least one such display stand.

The invention also concerns a structure for exhibiting watches including at least one such display case or at least one such display stand.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
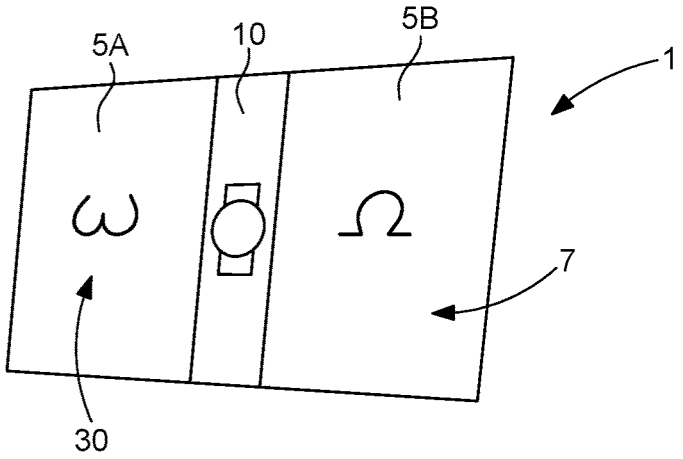
FIG. 1 represents a schematic perspective view of a display stand according to the invention, with two sliding shutter panels, provided with video screens, surrounding an orifice, through which emerges a support bearing a watch.
Figure 2:
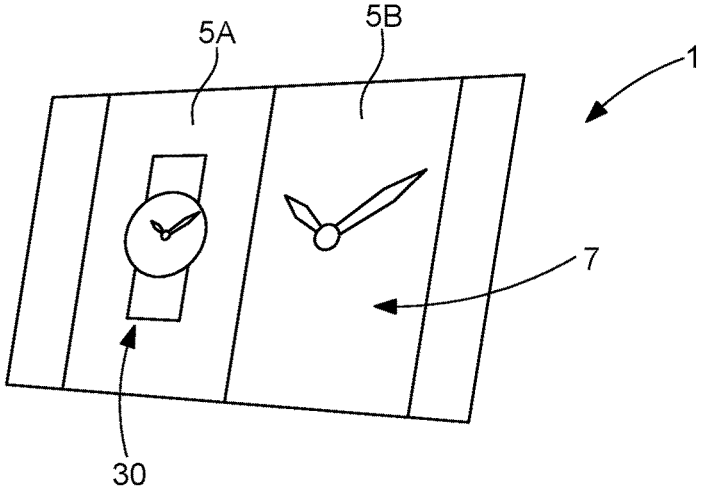
FIG. 2 represents the same display stand in a closed position of the shutter panel, the watch being confined within a compartment closed by said shutter panels.
Figure 3:
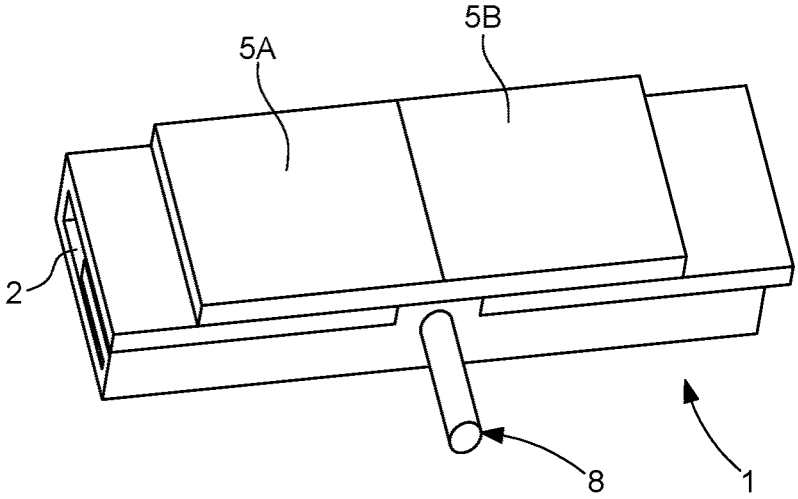
FIG. 3 illustrates the structure of this display stand, in the position of FIG. 23.
Figure 4:
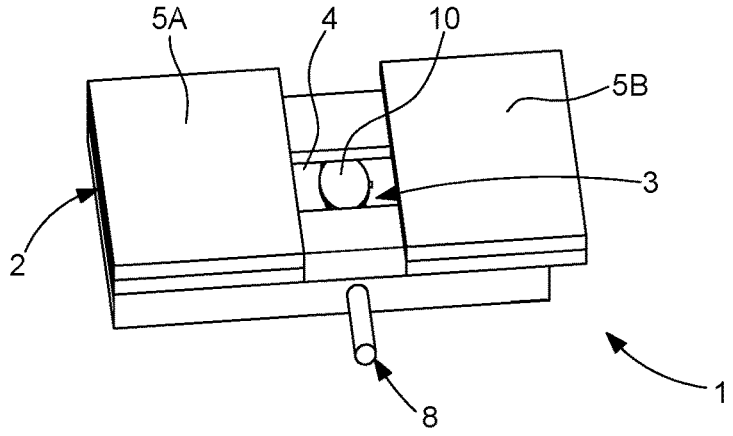
FIG. 4 shows the shutter panels in the closed position, with the support bearing a watch still at the bottom of the display orifice.
Figure 5:
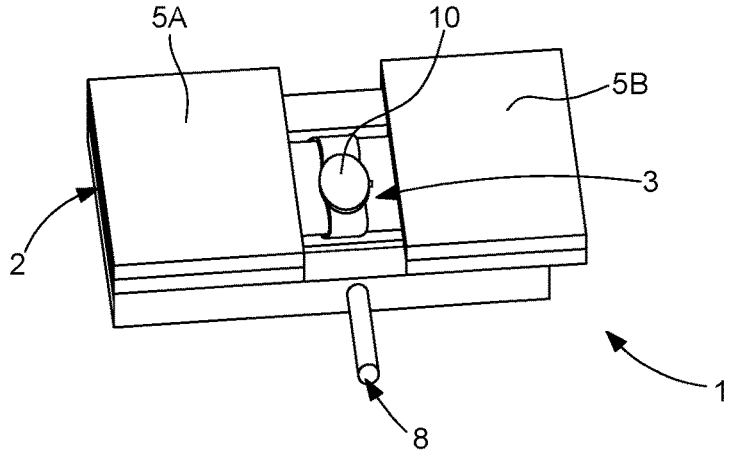
FIG. 5 illustrates the position of FIG. 1, with the support projecting through the orifice.
Figure 6:
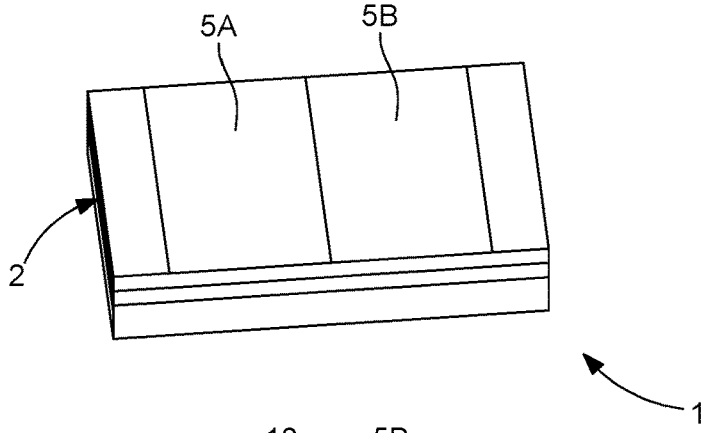
FIG. 6 illustrates the position of FIG. 2.
Figure 7:
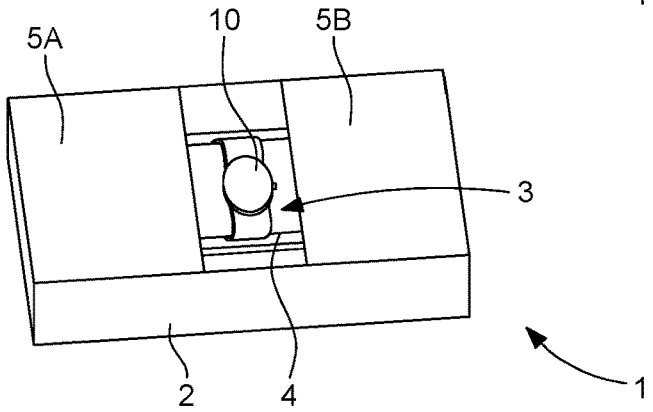
FIG. 7 illustrates the position of FIG. 5 from another angle.
Figure 8:
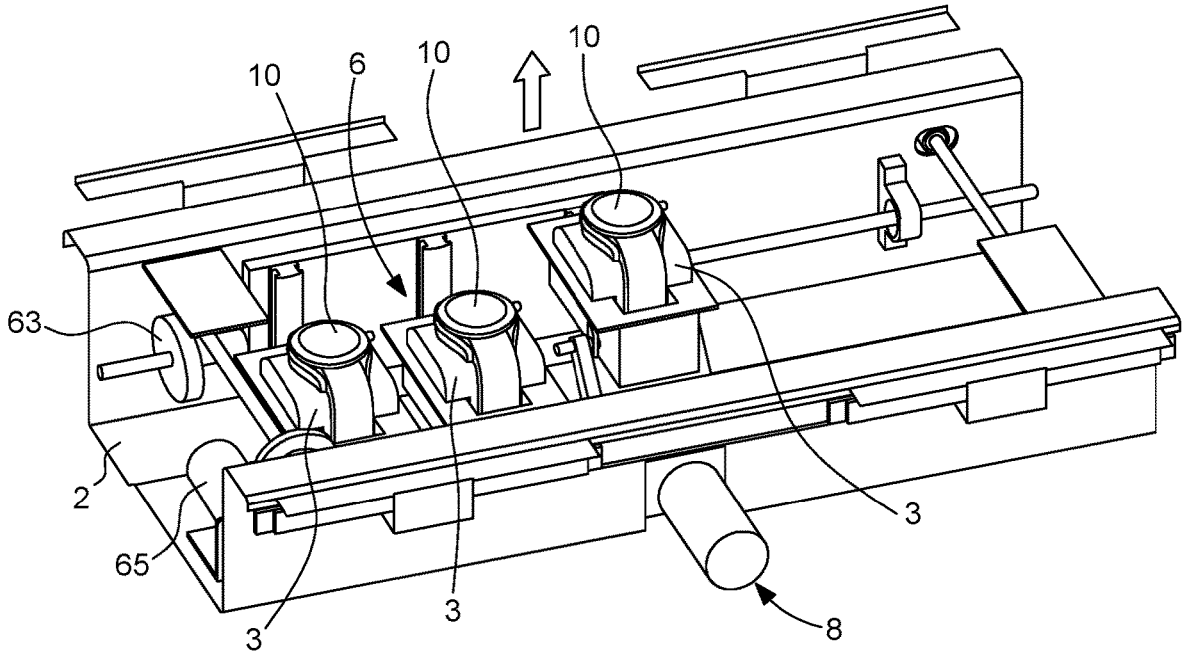
FIG. 8 illustrates a perspective view, with the shutter panels removed, of the mechanism of the same display stand, with three supports each bearing a watch and a motor for operating them in translation, another motor being provided for moving the shutter panels in translation, and yet another motor provided for lifting the supports through the orifice, in the display position.
Figure 9:
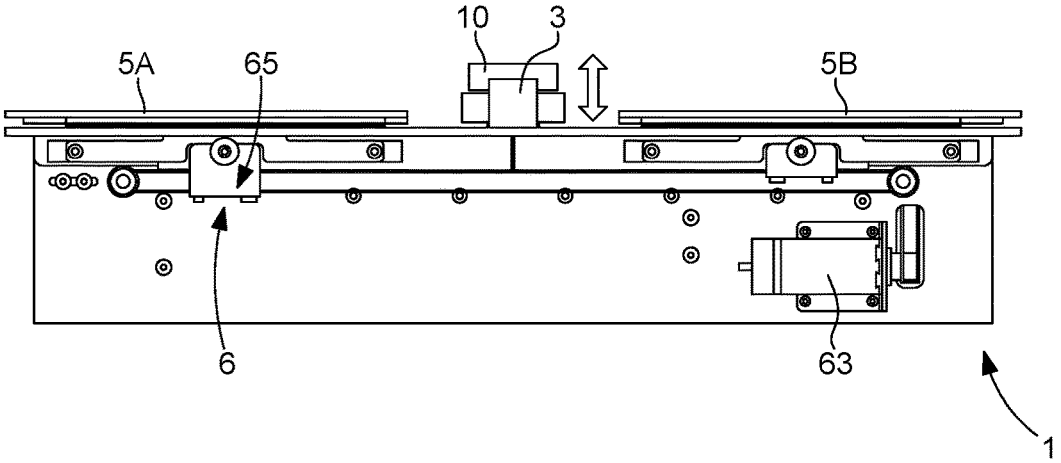
FIG. 9 is a side view of the mechanism of FIG. 8.
Figure 10:
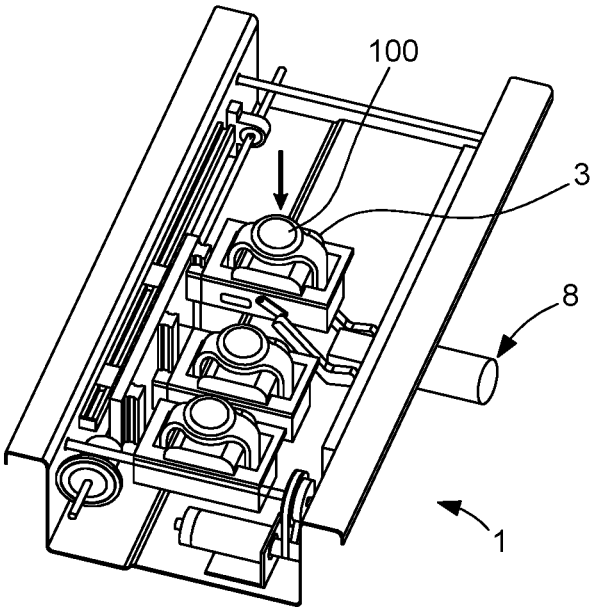
FIGS. 10 to 12 illustrate an operating sequence of the supports: lowering of the support which was in the display position, translation and positioning of another support opposite the display orifice, and finally the lifting of this latter support.
Figure 11:
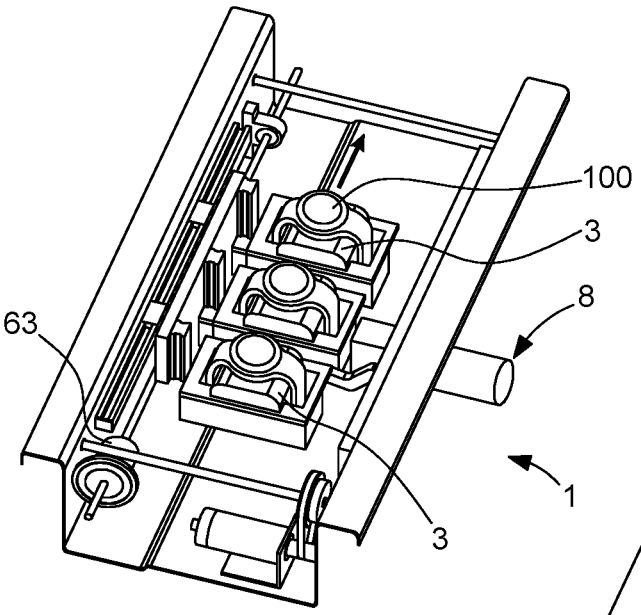
Figure 12:
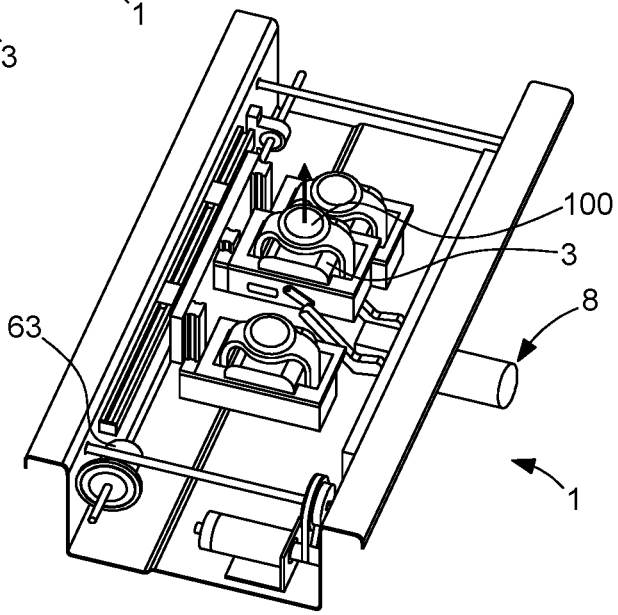
Figure 13:
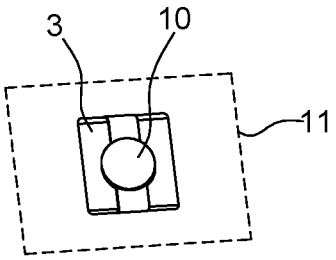
FIG. 13 illustrates a security space, achieved via sensors, around the watch in the display position above the shutter panels.
Figure 14:
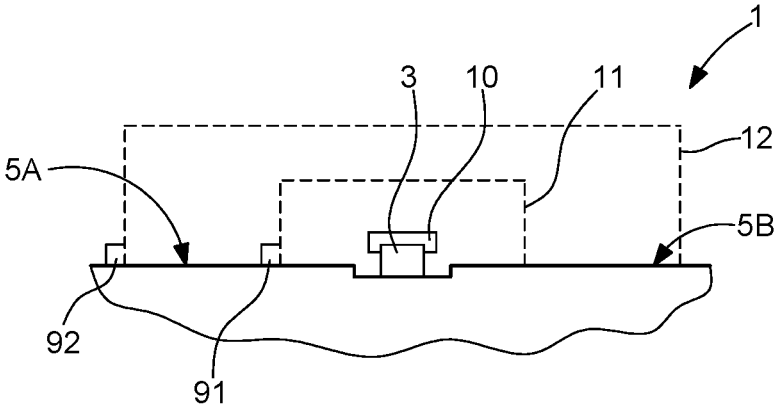
FIG. 14 is a diagram illustrating, around this security space, a control space in which a user can control the operations of the display stand through movements detected by other sensors.
Figure 15:
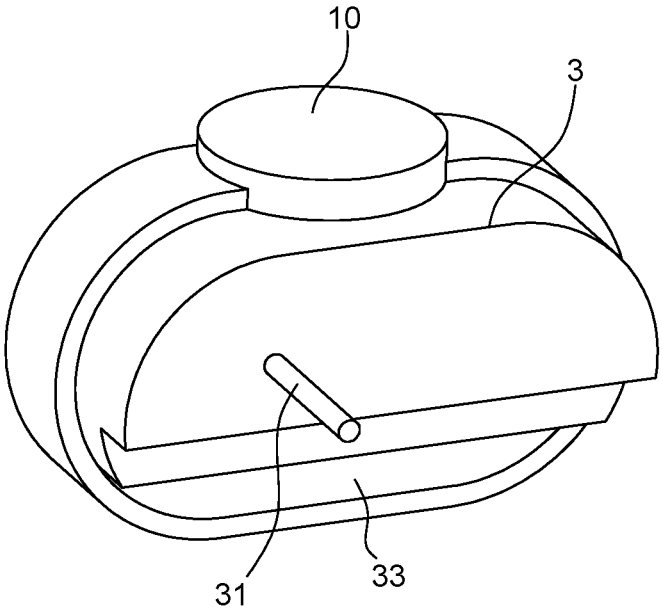
FIG. 15 represents a watch mounted on its support with a security pin.
Figure 16:
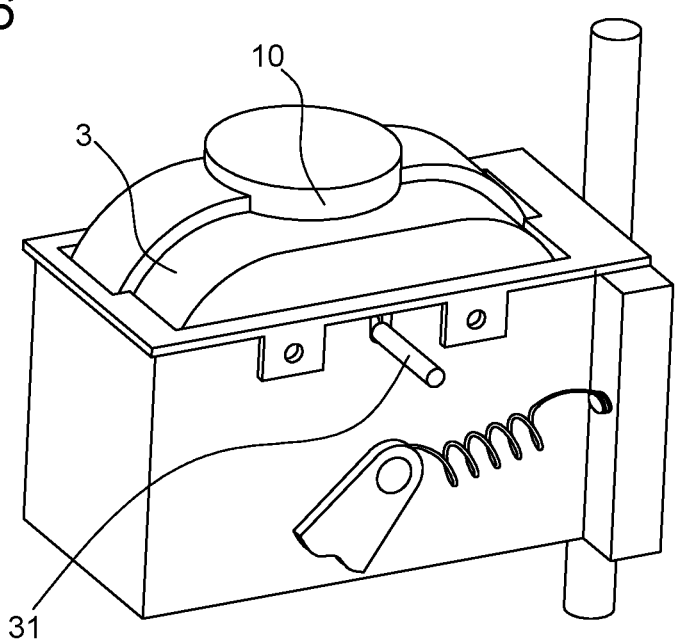
FIGS. 16 and 17 illustrate this support in a locked position, by the action of a catch on the pin.
Figure 17:
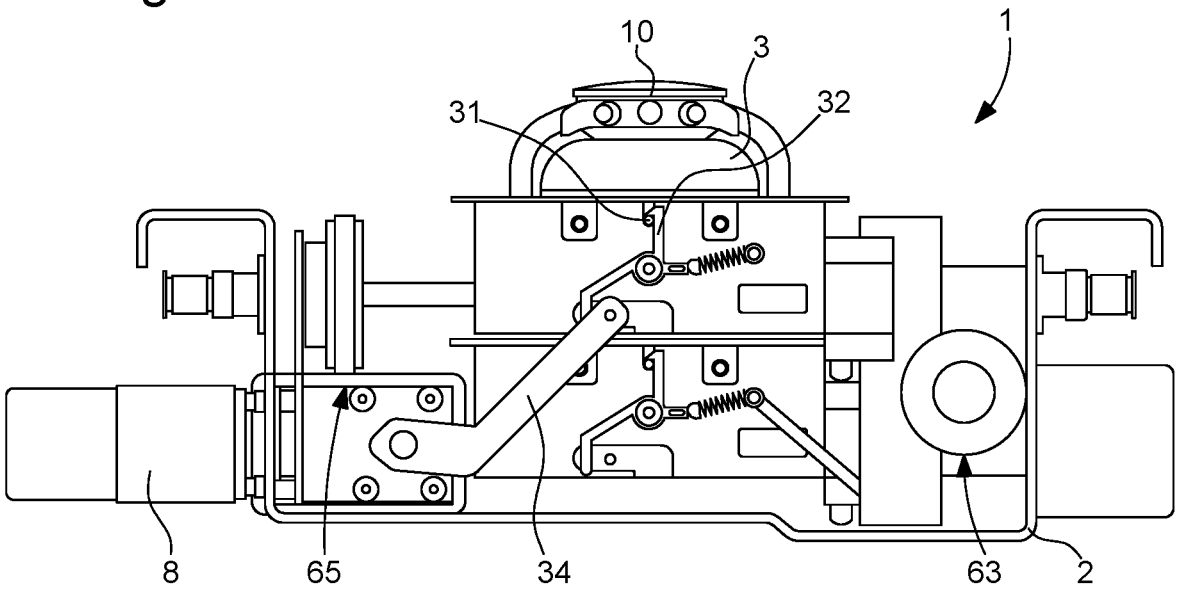
Figure 18:
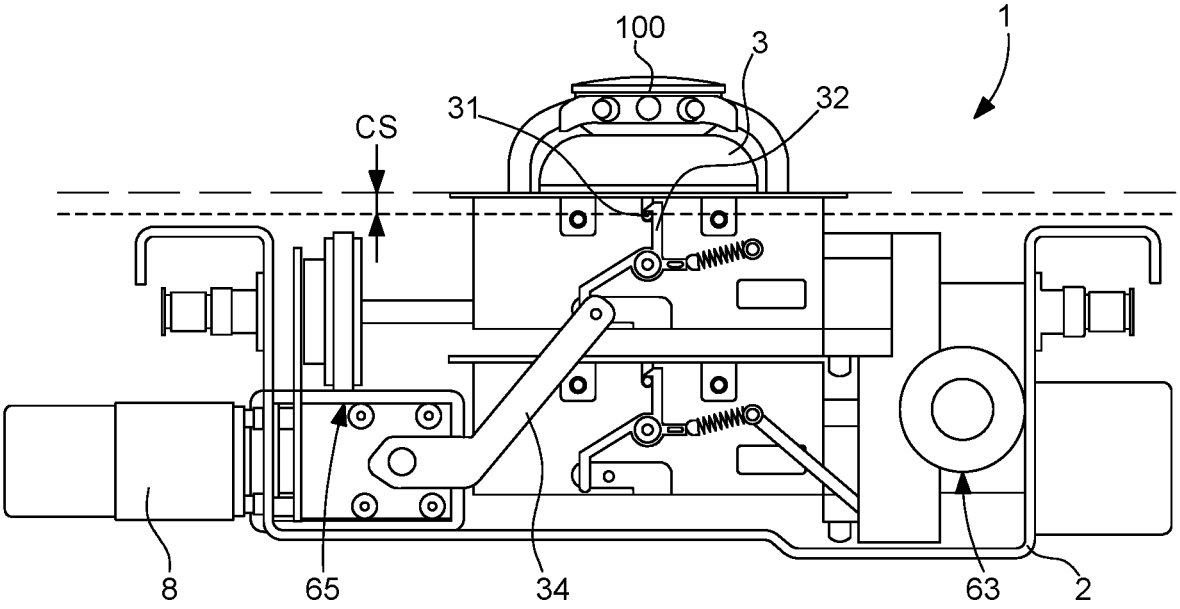
FIG. 18 illustrates unlocking, by the action of the elevation motor on a rod assembly, and with a safety travel allowing release of the catch.
Figure 25:
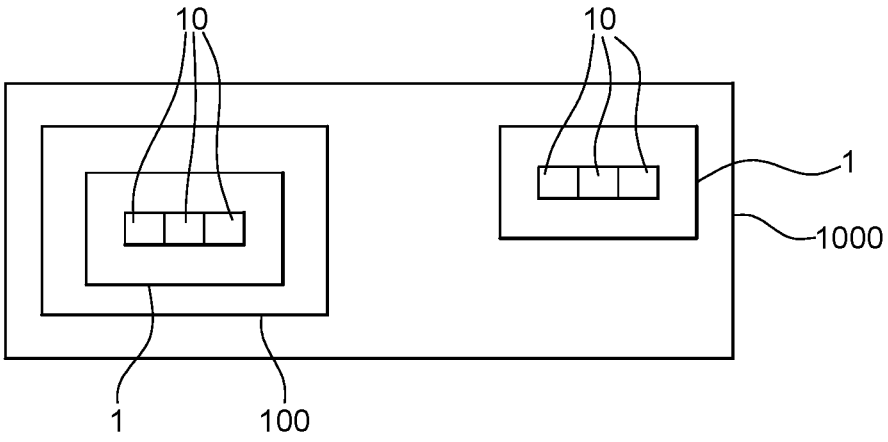
FIG. 25 schematically represents a structure for exhibiting watches comprising such a display case and such a display stand.
Figure 19:
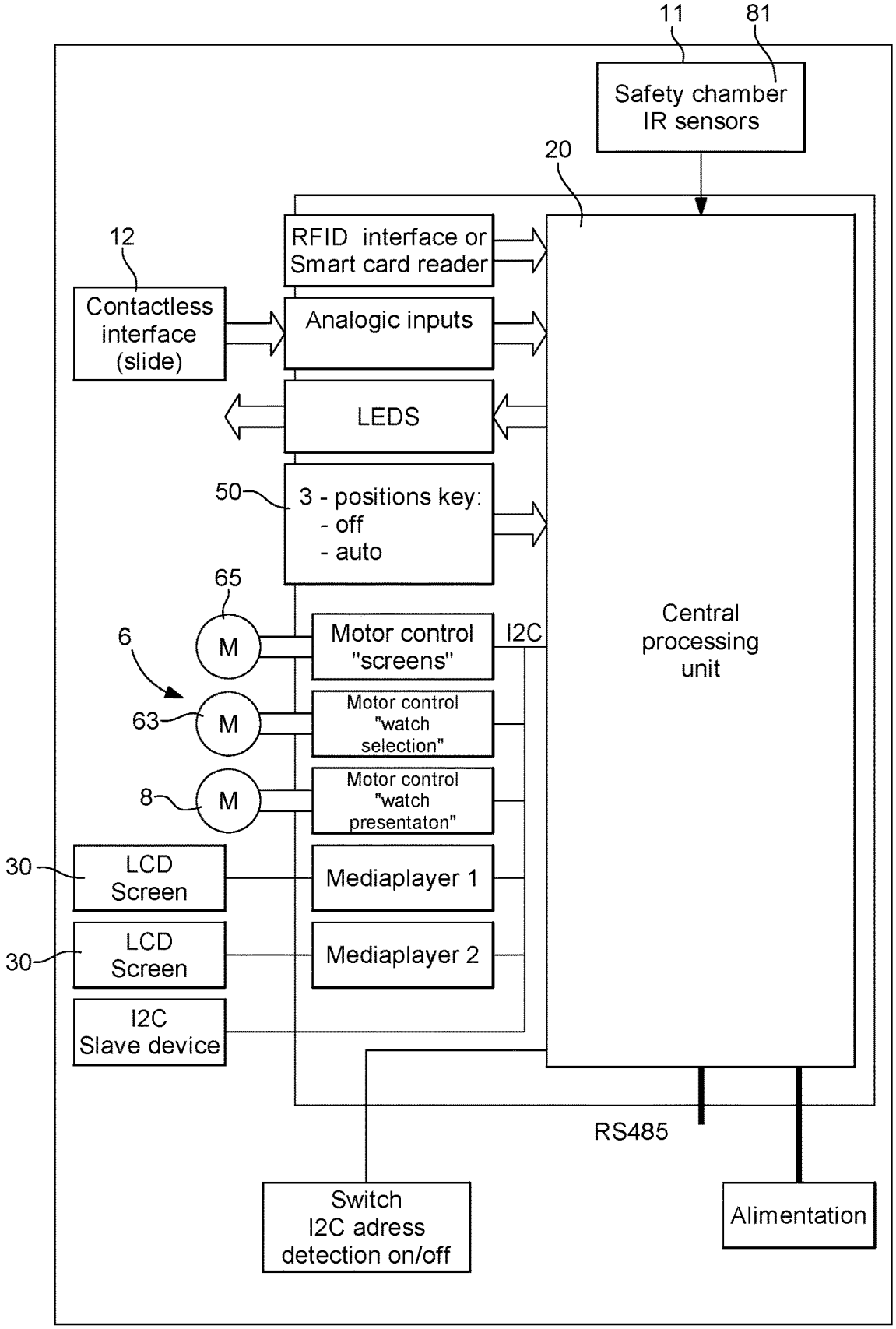
FIG. 19 is a diagram of the various drive and control circuits of the display stand.
Figure 20:
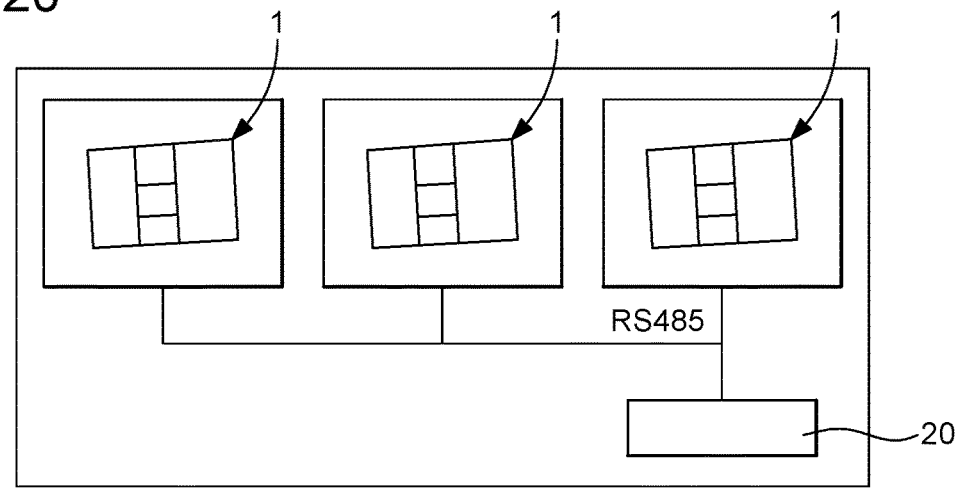
FIG. 20 illustrates the control of several display stands in a network.
Figure 21:
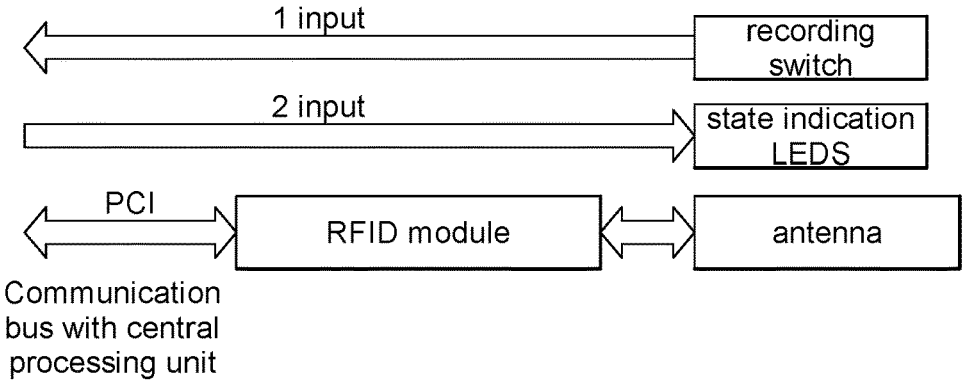
FIG. 21 illustrates control and updating via RFID.
Figure 22:
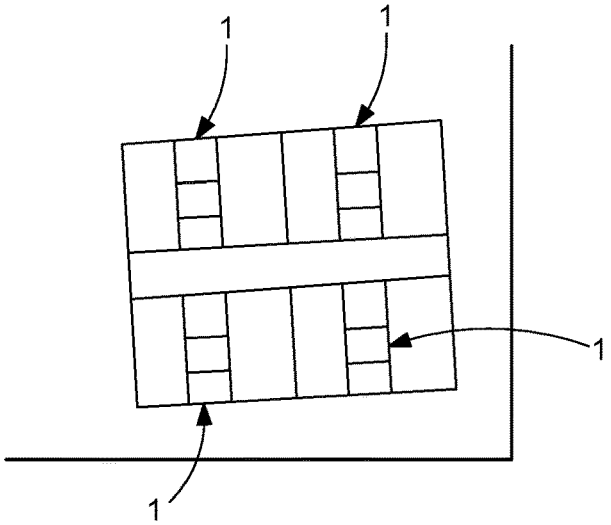
FIG. 22 illustrates a wall arrangement of a network of several display stands.
Figure 23:
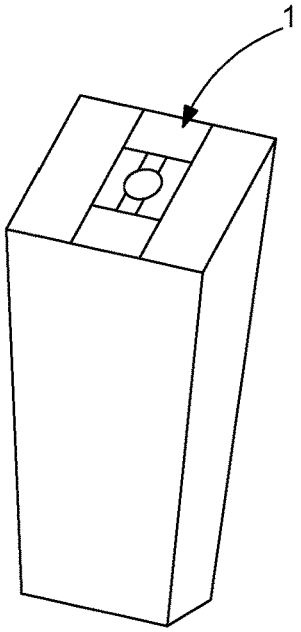
FIG. 23 illustrates a monolithic floor standing display cabinet.
Figure 24:
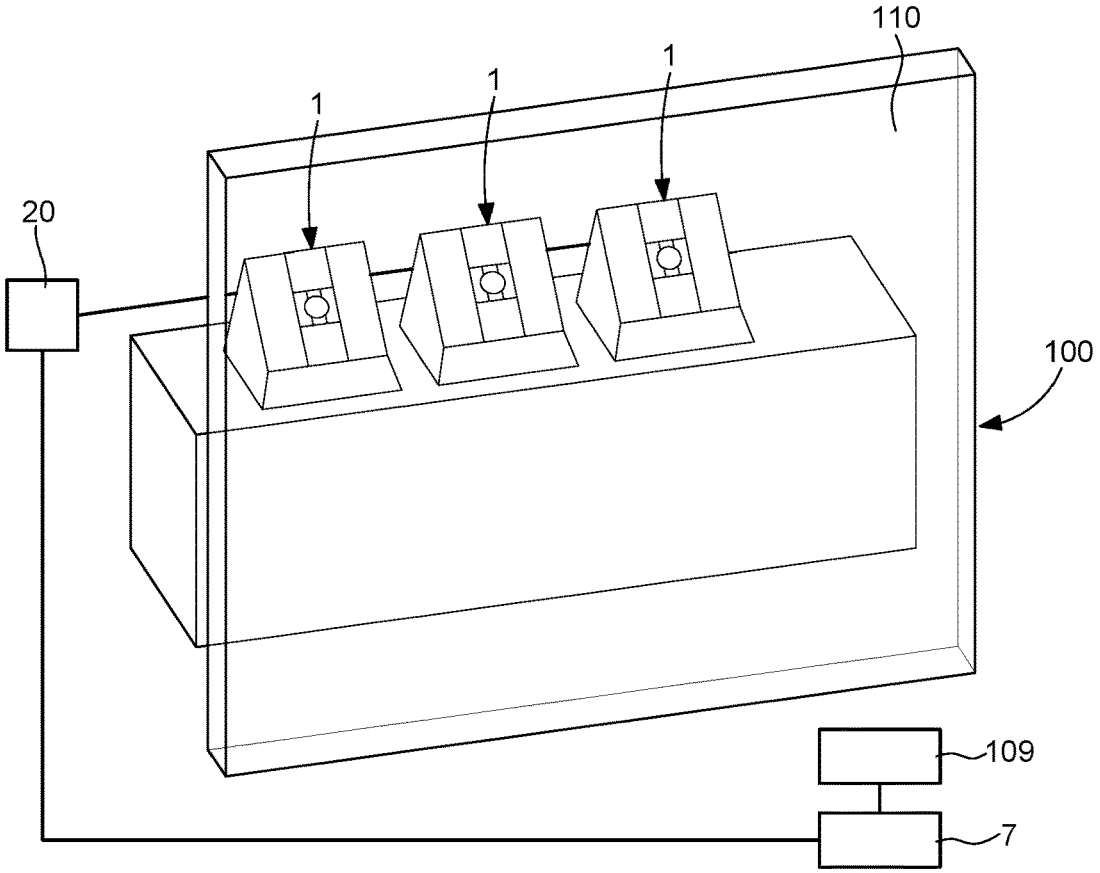
FIG. 24 illustrates a display case comprising a network of several display stands, behind a partition separating said stands from the public, with external detection means for detecting the hand movements of a user outside.

The invention concerns an interactive display stand 1 comprising a compartment 2 arranged to contain a plurality of objects 10 to be displayed, fixed on at least one support 3. These objects 10 may, in a non-limiting manner, be watches, pieces of jewelry, or other precious objects.

Compartment 2 forms an enclosed housing in its operating position, accessible through a single orifice 4.

Display stand 1 includes drive means 20 which are arranged to control operating means 6, which include transporting means 63 arranged to move at least one support 3 so that only one object 10 is visible at a time through orifice 4. Display stand 1 can thus be moved in a product presentation cycle.

This display stand 1 also includes control means 7 accessible to a user for the selection of an object 10. These control means 7 are interfaced with drive means 20, to control operating means 6 in order to align the support 3 bearing the selected object 10 with orifice 4, so that the user can view this object 10.

A user can thus ask to see a particular object, and his action on the control means can interrupt any presentation cycle, namely to display an object. Drive means 20 are also arranged to allow for safekeeping of an object 10 being displayed, to prevent any attempt to seize object 10 by a member of the public.

To this end, single orifice 4 is advantageously closable by at least one shutter panel 5. This shutter panel 5 is movable between a closure position in which no object 10 is visible, and an open position in which an object 10 is visible.

Operating means 6 include closure means 65 arranged to move at least one shutter panel 5, such that a single object 10 is visible at a time through orifice 4. Control means 7 thus control operating means 6 to align the support 3 bearing the selected object 10 with orifice 4, so that the user can view object 10, when said at least one shutter panel 5 is in the open position.

In a particular embodiment, at least one shutter panel 5 carries control means 7, particularly a touch screen 70 or suchlike, or is formed by such control means 7.

In a particular embodiment, at least one shutter panel 5 carries display means 30, especially a display screen, or is formed by such display means 30.

In a particular embodiment, at least one shutter panel 5 carries interactive means, which comprise both control means 7, and display means 30, or this at least one shutter panel is formed by such interactive means.

In a particular embodiment, illustrated by the Figures, display stand 1 includes an independent support 3 for receiving each object 10. Having an independent support 3 for each object 10 allows for a higher number of degrees of freedom, for example in translation in two perpendicular directions instead of a single translation, or otherwise.

In particular, display stand 1 includes several combined shutter panels 5 to close orifice 4 together, or conversely to open it completely and render orifice 4 and its content completely visible.

More particularly, display stand 1 includes sliding shutter panels 5, especially two sliding shutter panels 5, on either side of orifice 4.

In another variant not illustrated), display stand 1 includes pivoting shutter panels 5, on either side of orifice 4.

In a variant, operating means 6 include transporting means 63 arranged to move all the supports 3 in a synchronised manner.

In a variant, operating means 6 include transporting means 63 arranged to move at least one of supports 3 independently of the other supports 3.

In yet another variant, drive means 20 control operating means 6 and transporting means 63, arranged to move, depending on the desired cycle, either all of supports 3 in a synchronized manner, or at least one of supports 3 independently of the other supports 3.

In a particular embodiment, display stand 1 includes elevation means 8 for moving a support 3 in translation, through orifice 4, outwardly of compartment 2 in a first movement, and inwardly of compartment 2 in a second movement.

More particularly, operating means 6 comprise closure means 65, arranged to move all the shutter panels 5 thus arranged in order to close orifice 4 together, or to make said orifice completely visible, and the movement of elevation means 8 is synchronized with that of shutter panels 5, by drive means 20.

According to the invention, to ensure security of the displayed objects, display stand 1 comprises detection means 9 comprising security detection means 91, which are arranged to detect the presence of a user's hand in a security space 11, and which are interfaced with drive means 20, arranged to start a programmed cycle when such presence is detected, or to effect the locking of an object 10 within compartment 2 through orifice 4.

More particularly, these detection means 9 comprise command detection means 92 which are arranged to detect the movements of a user's hand within a control space 12 outside security space 11, and are interfaced with control means 7 for selection of an object 10, or for starting a programmed cycle according to the movements made. A users hand movement, for example from right to left, or from front to back, or from top to bottom, or vice versa, can thus activate new product displays or audio-visual presentations or suchlike.

In a particular variant, at least one shutter panel 5 includes such security detection means 91 and/or such command detection means 92.

In an advantageous variant, display stand 1 includes visual or audio-visual display means 30, and/or a touch screen 70 interfaced with control means 7 and drive means 20 for starting a programmed cycle.

More particularly, at least one programmed cycle includes at least one operation for displaying an object 10 through orifice 4.

More particularly at least one shutter panel 5 carries visual or audio-visual display means 30 and/or at least one touch screen 70.

Preferably, supports 3 are suitable for presentation of precious and/or fragile merchandise.

Advantageously, display stand 1 includes, for each support 3 comprised therein, locking means 40 for immobilising an object 10 in a security position. In an illustrated variant, locking means 40 include mechanical unlocking performed by elevation means 8 upon a particular command of drive means 20, and/or by operation of a key selector 50.

Locking means 40 can thus operate a catch 32 to immobilise a pin 31 integral with support 3, or suchlike; this catch 32 can be controlled by a rod assembly 33 at the output of a motor comprised in elevation means 8, or suchlike.

Preferably, elevation means 8 are arranged to move a support 3 entirely inside compartment 2 in the second movement in less than 200 milliseconds.

The invention also concerns a display case 100 including at least one such display stand 1. This display case 100 includes at least one partition 110 between each display stand 1 and the public, such as a glass wall, a partition grill, or otherwise, and includes, on the opposite side of partition 110 to display stands 1, external detection means 109, which are arranged to detect a user's hand movements, and are interfaced with control means 7 for selection of an object 10 or for starting a programmed cycle according to the movements made. The public therefore has the possibility of viewing products and the display thereof, even outside staff hours, which is advantageous, in particular for store fronts, which can thus have an animated nocturnal window display for example, with presentation of products that can rapidly be locked inside secure compartments 2 in the event of break-ins or suchlike. In a particular variant, compartment 2 is armoured, as are the shutter panels 5 used to close it.

The invention also concerns a structure for exhibiting watches 10 comprising at least one such display case 100, or at least one such display stand 1, each support 3 of which is arranged to bear a watch 10.

The Figures illustrate a particular and non-limiting embodiment of the invention, wherein display stand 1 include two movable shutter panels 5, which move apart to display an object 10, especially but not limited to a watch in the illustrated example, or a piece of jewelry, with a security system.

This display stand 1 has the following functionalities:

- displaying an object 10, particularly a watch, in a natural manner;
- safeguarding objects 10, particularly watches;
- ability to display several objects 10, for instance, in the illustrated example, three different watches with only one watch displayed at a time);
- safeguarding the watch which is placed on its support, which can conventionally include a substantially annular stand, called a 'C-ring';
- making the watch disappear by closing the two shutter panels;
- offering maximum integration flexibility with very varied forms and arrangements: monolithic, table, wall arrangement, or otherwise.

Display stand 1 according to the invention has the advantage of great versatility, allowing it to be incorporated in any type of display case.

Numerous product presentation sequences are possible, both with a stand-alone display stand 1, and with a network of several such display stands 1.

For example, in terms of interaction, a stand-alone display stand includes several screens, for example a shutter panel screen 5, and shows a film on each screen, this film being shown in a loop with a visual display of the movements of the shutter panels, screens and objects 10, particularly watches. If detection is actuated, the watch on display is moved back inside compartment 2, at the same time that a film is started. After several seconds, the normal sequence starts again.

A visitor can also request a change of watch or video presentation or suchlike by means of the sensor detecting his hand movements particularly right to left and left to right).

A network of several synchronized display stands is particularly attractive. In terms of interaction, it is then possible to start animations wherein the videos and watch displays are synchronized. The visitor can also interact with the assembly by means of the motion sensor.

In the illustrated mechanism, the system is defined by three movements, each having its own motor, and driven independently of one another. Synchronization of the movements is effected by a control programme in drive means 20. These three movements are:

opening/closing the shutter panels translational motion of shutter panel 5)

ascent/descent of the watch in the centrecam movement for example)

change of watch translational motion of support 3)

The shutter panels 5 and/or screens are advantageously covered by a glass panel comprising opaque and/or smoked films to conceal the edges of the screens. The shutter panels and/or screens are selected to minimise the edges at the centre, when the two shutter panels are closed. Advantageously, in order to increase reliability and reduce production costs, the movement of the shutter panels occurs above another glass panel, also provided with an opaque film, without using a flap which would fill the space between the shutter panels and flush therebetween There are therefore few moving components, and visual uniformity is provided by the glass panels.

The watch elevation mechanism can cause the watch to protrude by around 36 mm here, which is sufficient for it to be viewed, and compatible with rapid retraction in case of attempted theft.

To detect intrusion into security space 11, detection means 9 comprise an arrangement of sensors, particularly infra red sensors, which can detect an object approximately 10 cm around and above the watch. In the event of detection, the system immediately moves the displayed watch back inside and closes the shutter panels. In case of a system power failure, a sufficient power reserve allows the watch to be moved back inside and the shutter panels closed.

In any event, the watch support remains mechanically locked to the assembly. It is therefore impossible to remove the watch from its support without previously requesting the module to release it by means of a key switch).

Watch support 3 is secure: each watch is placed on a C-ring stand which is locked by a latch fastening, and which is unlocked on demand by means of the motor of elevation means 8 of the watch in the centre. The C-ring stand is formed of two parts: a sheathed stud comprising a through pin 31 for locking onto the mechanical device, and a sheathed foam element, available in two sizes to give the assembly elasticity and to fit both men's watches and ladies' watches. The C-ring can accommodate watches of large dimensions. Once the watch is attached to the C-ring, the assembly is clipped into the supports provided for such purpose, each mounted on a vertical linear guide. Locking is effected by two hooks 32, each bearing on pin 31 of the C-ring. Thereafter it is impossible to remove the watch without actuating the locking hooks.

Unlocking is effected by means of the motor of elevation means 8. To unlock the watch, the support moves out further by an additional travel of at most 6 mm, thereby displacing the hooks and releasing the watch support. This mechanism is actuated via a key selector 50.

In control space 12 outside security space 11, detection means 9 include command detection means 92, in particular motion sensors. In order to interact with the system change of video, of watch displayed, or otherwise) an array of infra red sensors, notably in a line, can remotely detect a motion, particularly from right to left, and a motion from left to right. This sensor array is independent of the rest of the mechanism and can consequently easily be moved, as in the application of display case 100.

The use of a rotary sequencer can synchronize several display stands 1 according to the invention, for example with RS485 connections or suchlike.

The system response speed for starting a video from the command is 0.150 seconds which is very short and almost imperceptible to the user.

A variant comprises an RFID reader module for unlocking and/or updating the sequences using RFID badges.

Various arrangement configurations of the mechanism are possible:

wall arrangement: several modules are secured to a wall or incorporated in the wall), and can be synchronized with each other;

monolithic: an independent module is incorporated in a monolithic floor standing cabinet;

interactive window display: the modules are placed in a store window with interaction possible from outside the store, by means of the infra red motion sensors.

Unlocking of the watches is RFID controlled. By default, the watch is unlocked by means of the key. It is possible to replace this key system with an RFID card reader contactless) Unlocking is then achieved simply by passing a tag close to the display case.

In addition to the RFID watch unlocking system, it is also possible to update the sequences by RFID, through the use of suitable RFID cards. The display case is managed by means of contactless cards.

What is claimed is:

1. An interactive display stand comprising a compartment arranged to contain a plurality of objects to be displayed, secured to at least one support, said compartment forming an enclosed housing accessible through a single orifice, said display stand comprising drive means arranged to control operating means, which comprise transporting means arranged to move at least one said support, such that a single object is visible at a time through said orifice, and said display stand comprising control means accessible to a user for selection of said object, and interfaced with said drive means, to control said operating means in order to align said support bearing said selected object with said orifice, to allow the user to view said object, wherein said display stand comprises detection means comprising security detection means, arranged to detect presence of a user's hand within a security space, and interfaced with said drive means arranged to start a programmed cycle when said presence is detected, or to effect locking of said object within said compartment through said orifice.

2. The display stand according to claim 1, wherein said single orifice is closable by at least one shutter panel movable between a closure position wherein no said object is visible, and an open position wherein one said object is visible, and wherein said operating means include closure means arranged to move at least one said shutter panel, such that only one said object is visible at a time through said orifice.

3. The display stand according to claim 2, wherein at least one said shutter panel carries said control means, or is formed by said control means.

4. The display stand according to claim 2, wherein at least one said shutter panel carries display means, or is formed by said display means.

5. The display stand according to claim 2, wherein at least one said shutter panel carries said control means, or is formed by said control means, and wherein at least one said shutter panel carries display means, or is formed by said display means, and wherein at least one said shutter panel carries interactive means that include both said control means and said display means, or said at least one shutter panel is formed by said interactive means.

6. The display stand according to claim 1, wherein said display stand includes one said support for reception of each said object.

7. The display stand according to claim 1, wherein said display stand includes several said shutter panels combined to close said orifice together or to make said orifice entirely visible.

8. The display stand according to claim 7, wherein said display stand includes two sliding said shutter panels on either side of said orifice.

9. The display stand according to claim 7, wherein said display stand includes two pivoting said shutter panels on either side of said orifice.

10. The display stand according to claim 1, wherein said operating means comprise transporting means arranged to move all said supports in a synchronized manner.

11. The display stand according to claim 1, wherein said operating means comprise transporting means arranged to move at least one of said supports independently of the other said supports.

12. The display stand according to claim 1, wherein said display stand includes elevation means for moving one said support in translation, through said orifice, outwardly of said compartment in a first motion, and inwardly of said compartment in a second motion.

13. The display stand according to claim 12, wherein said operating means comprise closure means arranged to move all said shutter panels arranged to close said orifice together, or to make said orifice completely visible, and wherein motion of said elevation means is synchronized with that of said shutter panels.

14. The display stand according to claim 12, wherein said display stand includes, for each said support comprised therein, locking means for immobilising said object in a security position, and wherein said locking means comprise mechanical unlocking performed by said elevation means upon a particular command of said drive means and/or by operation of a key selector.

15. The display stand according to claim 12, wherein said elevation means are arranged to move said support completely inside said compartment in said second motion in less than 200 milliseconds.

16. The display stand according to claim 1, wherein said detection means include command detection means arranged to detect a user's hand movements within a control space outside said security space, and are interfaced with said control means for selection of said object or for starting a programmed cycle according to the movements made.

17. The display stand according to claim 1, wherein said display stand includes visual or audio-visual display means and/or at least one touch screen interfaced with said control means and said drive means for starting a programmed cycle.

18. The display stand according to claim 17, wherein at least one said programmed cycle includes at least one operation for displaying said object through said orifice.

19. The display stand according to claim 1, wherein said display stand includes, for each said support comprised therein, locking means for immobilising said object in a security position.

20. A display case comprising at least one display stand according to claim 1, wherein said display case includes at least one partition separating each said display stand from the public, and includes, on an opposite side of a wall to said display stands, external detection means arranged to detect a user's hand movements, and interfaced with said control means for selection of said object or for starting a programmed cycle according to the movements made.

21. A watch display structure comprising at least one display case according to claim 20, wherein each said support is arranged to carry a watch.

* * * * *